US006024657A

United States Patent [19]

Bettencourt, Jr.

[11] Patent Number: 6,024,657

[45] Date of Patent: Feb. 15, 2000

[54] BATTING PRACTICE DEVICE

[76] Inventor: Manuel J. Bettencourt, Jr., 2961 Pacific Hwy., Medford, Oreg. 97501

[21] Appl. No.: 08/951,830

[22] Filed: Oct. 14, 1997

[51] Int. Cl.[7] ..... A63B 69/40

[52] U.S. Cl. ..... 473/427; 473/429; 473/430

[58] Field of Search ..... 473/427, 429, 473/430, 426, 424, 425, 139, 147, 149

[56] References Cited

U.S. PATENT DOCUMENTS

| | | | |
|---|---|---|---|
| 795,960 | 8/1905 | Cook | 473/424 |
| 2,307,905 | 1/1943 | Ament | 119/708 |
| 2,547,776 | 4/1951 | Rankin | 473/424 |
| 2,751,226 | 6/1956 | Conway | 473/427 |
| 2,942,883 | 6/1960 | Moore | 473/424 |
| 2,944,817 | 7/1960 | Stiller | 473/424 |
| 3,214,166 | 10/1965 | Gaudet | 473/424 |
| 3,351,343 | 11/1967 | Papp | 473/430 |
| 3,540,726 | 11/1970 | Davis | 473/427 |
| 3,731,925 | 5/1973 | Caldwell | 473/424 |
| 4,032,145 | 6/1977 | Tami | 273/317.8 |
| 4,415,155 | 11/1983 | Goudreau et al. | 473/424 |
| 5,433,435 | 7/1995 | Bourie | 473/429 |
| 5,443,576 | 8/1995 | Hauter | 473/424 |
| 5,516,116 | 5/1996 | Castro | 473/429 |

*Primary Examiner*—Benjamin H. Layno
*Attorney, Agent, or Firm*—Kolisch, Hartwell, Dickinson, McCormack & Heuser

[57] ABSTRACT

A batting practice device for use by a person acting as a pitcher and another person acting as a batter. A pole has a first end placed on the ground and a second end held substantially vertically. The pole is longer than the height of the pitcher, but is not permanently mounted in the ground. The pitcher prevents substantial movement of the first end of the pole by placing a foot in an anchoring loop provided at the first end of the pole. A line is operatively attached, via a freely rotating mount, to the second end of the pole. The line has a swivel connection to prevent twisting of the line. The line is operatively connected to a ball via a ball harness. The ball harness has two straps sewn together, with the ends of the respective straps having loops for receiving one end of the line. Various sizes of conventional balls can be easily inserted and removed from the ball harness.

16 Claims, 3 Drawing Sheets

BATTING PRACTICE DEVICE

FIELD OF THE INVENTION

The present invention relates generally to devices for practicing sporting skills. More specifically, the present invention relates to a batting practice device.

BACKGROUND OF THE INVENTION

For many sports it is important for a player to develop hand-eye coordination. This is especially true in baseball where a batter must hit a fast-moving ball with a bat. Developing the necessary coordination to hit a baseball can take considerable time. Over the years, various methods have been developed to teach this skill. One method includes placing a ball on a stationary pole or tee, whereupon the batter attempts to hit the ball off the tee. Using a tee develops basic hand-eye coordination, but does not allow a batter to practice hitting a moving ball.

Another method uses a ball permanently fastened to the first end of a rope. A "pitcher" holds the second end of the rope and swings the ball around in a circle. The batter stands outside the orbit of the moving ball and attempts to hit the ball with the bat. The second end of the rope can be attached to a pole. The pole helps the ball achieve greater centrifugal motion and gives the pitcher more control of the movement of the ball.

Previous practice devices of this type were effective in helping a batter develop hand-eye coordination, but these devices had shortcomings. If the pole was small enough to be held by the pitcher, the pitcher was required to hold the entire device and use his body to counteract the swinging motion of the ball. Ordinarily this would quickly fatigue the pitcher. On the other hand, if the pole was too long to be held by the pitcher, the pole was permanently mounted in the ground. This solution compromised the portability of the device and limited the pitcher's control of the movement of the ball.

Most previous practice devices required a hole to be drilled into the ball for attachment to the rope. This prevented use of the ball in other applications, and also did not allow inexpensive replacement of the ball with standard baseballs. Replacement is important because the ball will become damaged or worn after repeated use. Furthermore, it is more economical and inexpensive to allow replacement of the ball with common baseballs or softballs that do not require any special mounting operations.

The devices that did not require drilling a hole in the ball were adapted to allow the use of only one size of ball. If the batter desired to practice hitting a ball of a different size, a different apparatus would have to be used.

SUMMARY FOR THE INVENTION

The present invention overcomes these problems by providing a pole that is longer than the height of the pitcher, but is not permanently mounted in the ground. The pitcher prevents substantial movement of the bottom of the pole by placing a foot in an anchoring loop provided at the bottom of the pole. The pole is completely portable and no permanent ground mount is required.

The present invention further has a ball harness which does not require a permanent connection between the ball and the line. The ball can easily be removed and used in other activities. In addition, the ball harness is fully adjustable to accept balls of different sizes.

DETAILED DESCRIPTION AND BEST MODE OF CARRYING OUT THE INVENTION

Figure 1:
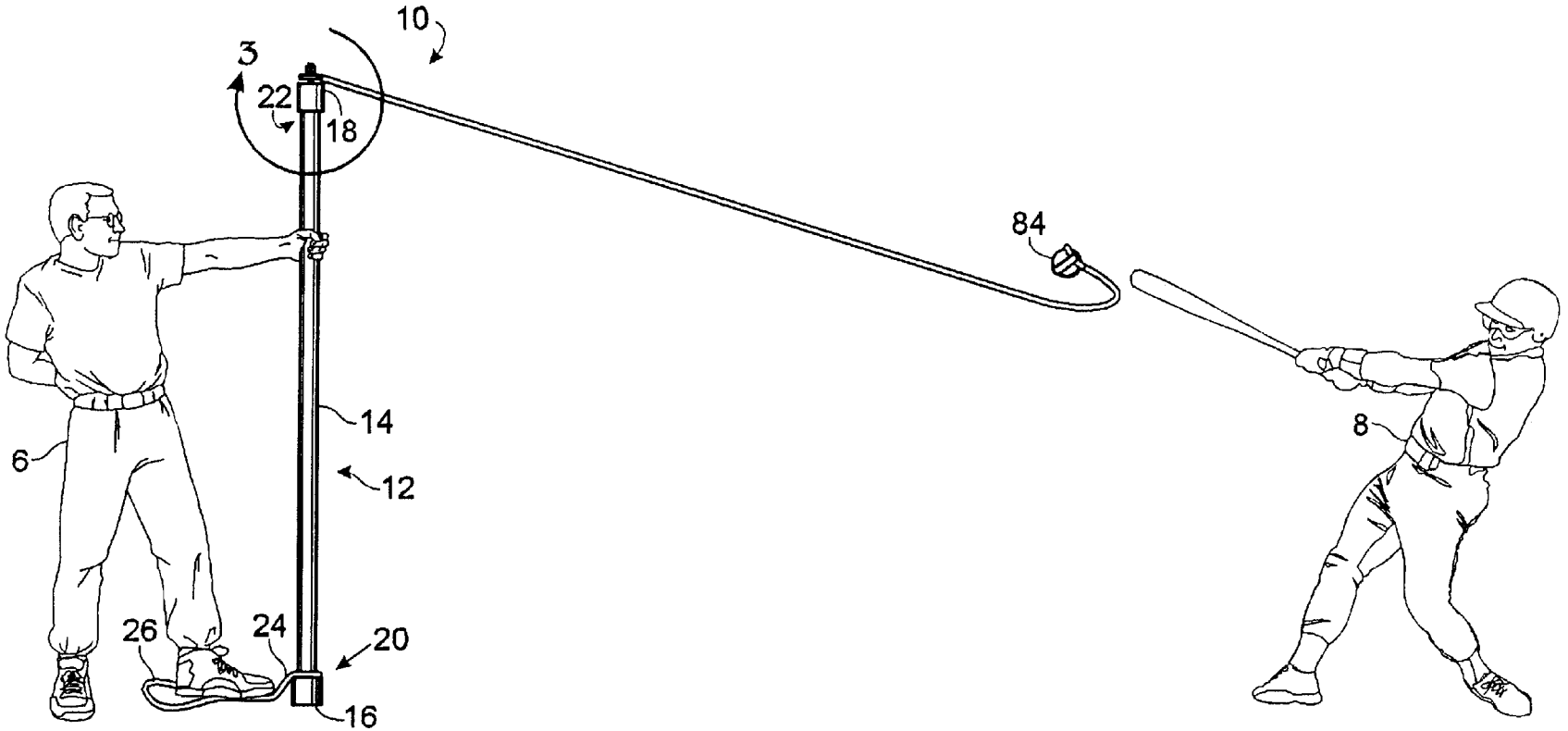
FIG. 1 shows a pitcher and a batter using the batting practice device of the present invention.

FIG. 1 shows a pitcher 6 and batter 8 using the batting practice device 10 of the present invention. A pole 12 forms the vertical support of device 10. Pole 12 can be a solid shaft made of plastic, metal, or wood, but preferably pole 12 comprises a hollow tube or pipe 14, with first and second caps 16, 18 attached to first and second ends 20, 22 of tube 14, respectively. Tube 14 and caps 16,18 can be made of metal, or preferably, durable plastic such as polyvinyl chloride (PVC). Pole 12 should be longer than the height of the pitcher, and is typically longer than 6 feet.

Anchor 26 is attached to first end 20 of tube 14. Anchor 26 limits lateral movement of first end 20 of tube 14 with respect to the ground in a manner that requires no part of the invention to be inserted or mounted in the ground. In the preferred embodiment anchor 26 comprises a loop of rope or cord knotted at 24 to the first end of tube 14. Of course, anchor 26 can be made of rope, cord, leather, or any similar material. Anchor 26 could also comprise a piece of wood, plastic, or metal operationally attached to first end 20 of tube 14. In use, a person would step on or through anchor 26 to help hold tube 14 in place as shown in FIG. 1.

Figure 2:
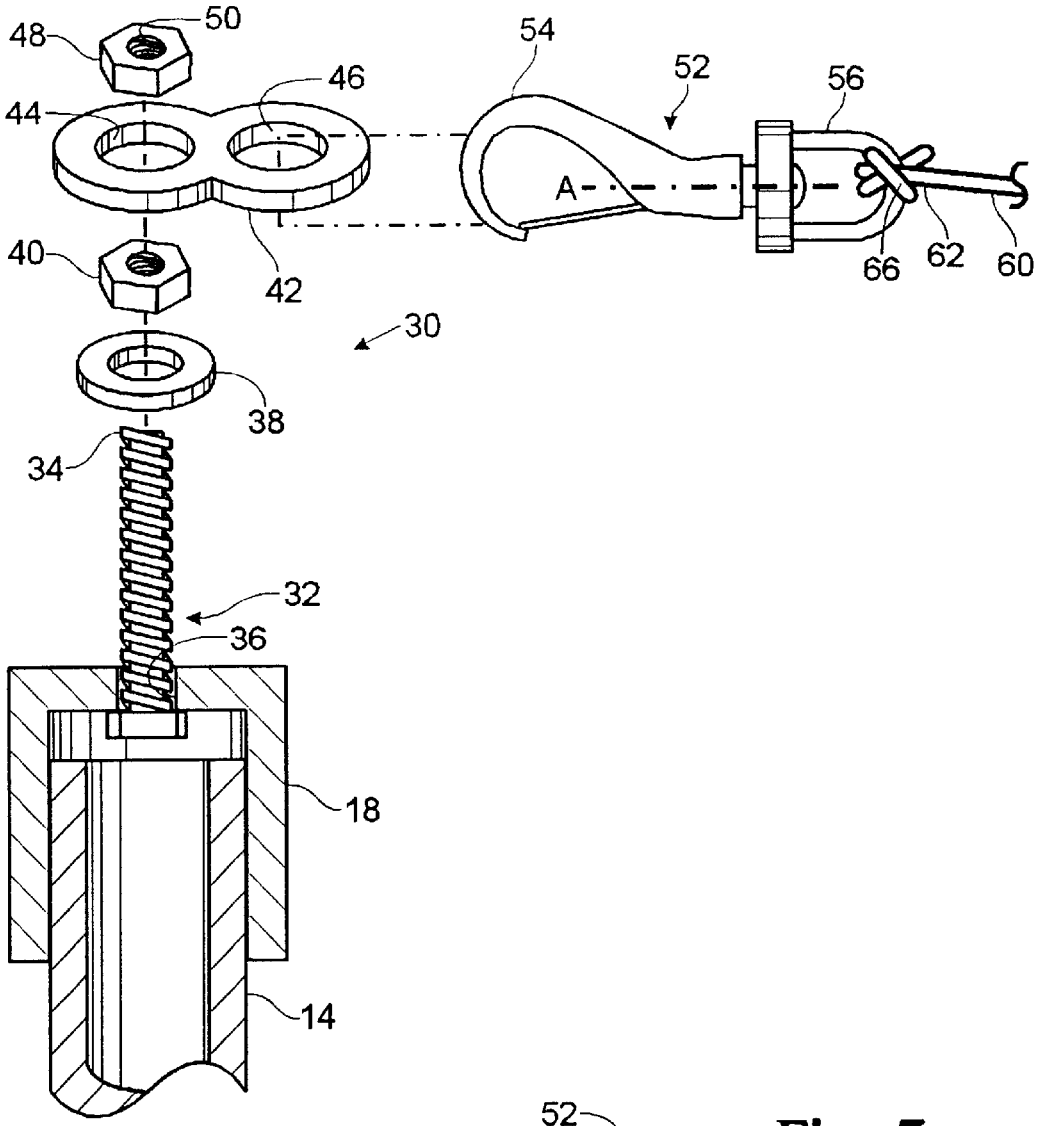
FIG. 2 is a side view of one end of the pole of the present invention, showing in particular the rotational connector assembly in exploded view.
Figure 3:
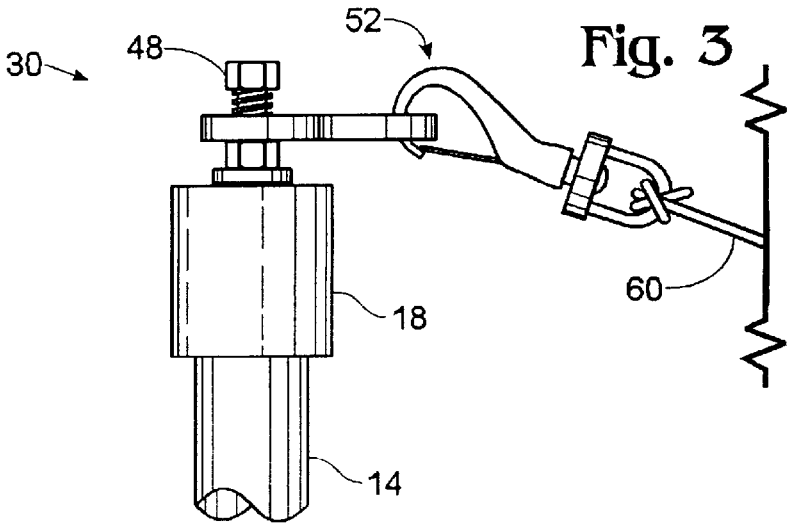
FIG. 3 is a side view of the fully assembled and connected rotational connector assembly and clip.

A detailed view of second end 22 of tube 14 is shown in FIG. 2. A rotational connector assembly 30 is disposed at the second end 22 of tube 14. Rotational connector assembly 30 comprises a bolt or pin 32 having a threaded end 34 inserted through a hole 36 in second cap 18 such that threaded end 34 extends outside second cap 18. Washer 38 and holding nut 40 are placed on threaded end 34. Holding nut 40 is tightened to retain bolt 32 on second cap 18. Double washer 42 has first and second holes 44, 46. Double washer 42 is mounted on threaded end 34 of bolt 32 through first hole 44. The diameter of first hole 44 is sufficiently large to allow double washer 42 to freely rotate with respect to bolt 32. Retaining nut 48 is mounted on threaded end 34 of bolt 32. The threads 50 of retaining nut 48 are modified such that retaining nut 48 freely threads onto bolt 32 until threaded end 34 of bolt 32 has gone nearly completely through retaining nut 48. This condition is shown in FIG. 3. Further rotation of retaining nut 48 tightens retaining nut 48 on threaded end 34 of bolt 32 such that retaining nut 48 is held on threads of bolt 32. Retaining nut 48 retains double washer 42 on bolt 32. Double washer 42 can freely rotate on bolt 32 between holding nut 40 and retaining nut 48.

Also shown in FIG. 2 is a clip 52 used in the present invention. Clip 52 is generally known in the art as a harness clip or a swivel clip. Clip 52 has a fastening end 54 which is removably inserted in second hole 46 of double washer 42. Swivel link 56 is rotatably attached to fastening end 54 of clip 52 and freely rotates with respect to the fastening end about rotation axis A.

Line 60 has a first end 62 and a second end 64. First end 62 is secured by a first knot 66 to swivel link 56. Line 60 can be made of cord, rope, wire, string, or some other similar material. If cord or rope is used, the ends thereof are treated to prevent fraying. Processes that can be used include end splicing and heat fusing.

Figure 4:
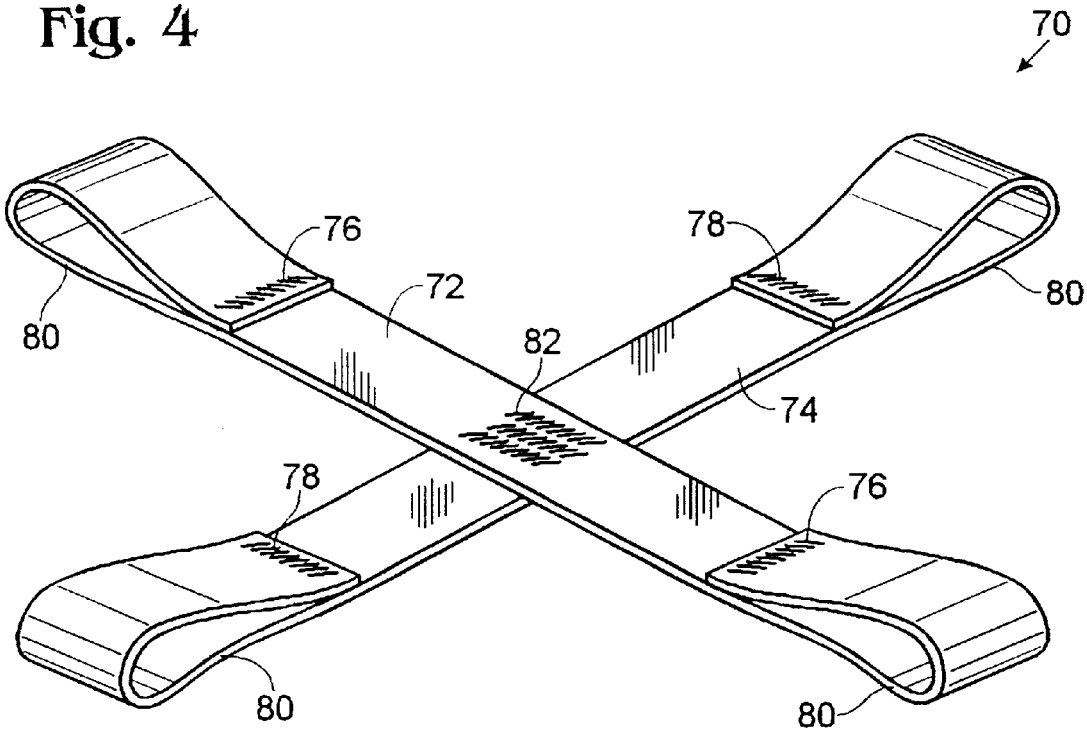
FIG. 4 is a perspective view of the ball harness.
Figure 5:
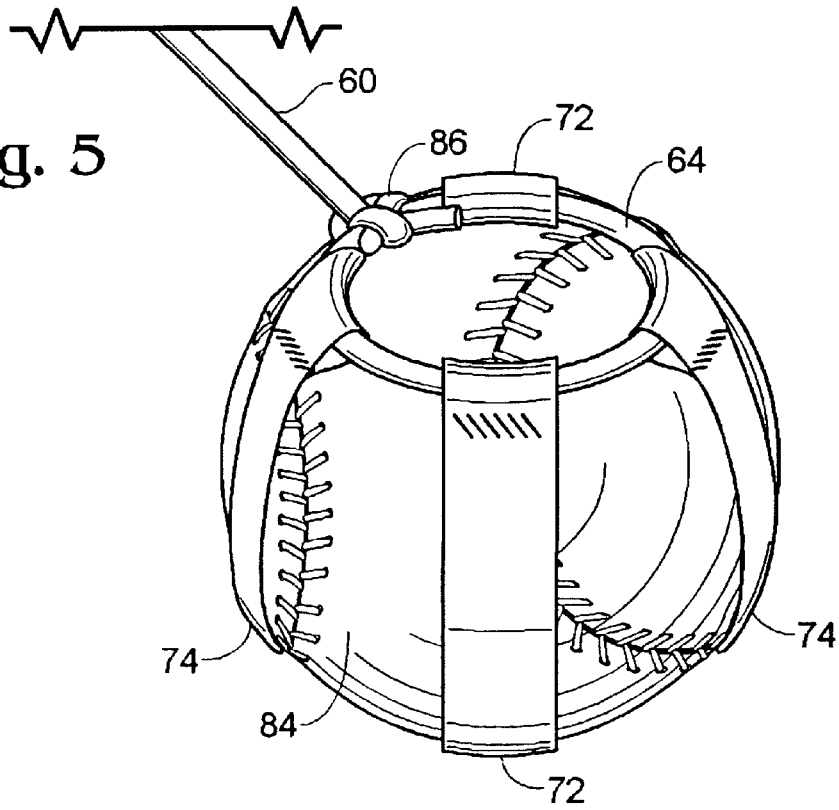
FIG. 5 is a perspective view of a ball enclosed by the ball harness.

FIGS. 4 and 5 show a ball harness 70 according to the present invention. Ball harness 70 includes first and second straps 72, 74. It is conceivable that one wide strap or more than two straps could be used in the harness. Straps 72, 74 are made of nylon, but could also be made of leather, canvas, or similar material. Each end of each strap 72, 74 is sewn or fastened as shown at 76 and 78 to create loops 80. First and second straps 72, 74 are sewn or fastened together at 82 so that straps 72, 74 intersect preferably at a 90-degree angle. Second end 64 of line 60 is loosely threaded through loops 80. A ball 84 is inserted in ball harness 70 such that straps 72, 74 surround ball 84. Ball 84 is secured within straps 72, 74 by tightening second end 64 of line 60 and securing ball 84 with second knot 86, as shown in FIG. 5. When second knot 86 is untied, straps 72, 74 are loosened and ball 84 can be removed from ball harness 70.

In operation, the device 10 is held upright by the pitcher 6. The pitcher 6 stands facing the batter 8 and holds first end 20 of tube 14 on the ground, preferably but not necessarily by standing on or through anchor 26. The pitcher 6 moves second end 22 of tube 14 in a circle to cause ball 84 to swing in an orbit around pole 12. The pitcher 6 causes ball 84 to orbit in a counter-clockwise direction (as seen from above) if the batter 8 bats right-handed, or in a clockwise direction if the batter 8 bats left-handed. The pitcher 6 manipulates the speed and trajectory of ball 84 by varying the rotation of pole 12. Rotational connector assembly 30 keeps line 60 from wrapping around pole 12, and rotation of swivel link 56 helps prevent twisting of line 60. The batter 8 stands outside the orbit of ball 84 but within range to strike ball with a bat as ball 84 passes by. Once ball 84 is hit, line 60 prevents the ball from travelling far, and it allows the pitcher to easily retrieve the ball and repeat the process. The invention thus allows a batter to practice hitting a moving ball without having to retrieve balls which are hit or which the batter misses.

One advantage of the present invention as compared to previous ball practice devices is that the present invention rests on the ground and is anchored by the foot of the pitcher. This reduces pitcher fatigue because the pitcher does not have to support the weight of the entire device during use. In addition, the present invention is easily portable and does not require a special in-ground mount for operation.

Another advantage of the present invention is that ball harness 70 is adapted to interchangeably receive various sizes of conventional balls. Straps 72, 74 automatically adjust to different sizes of balls when line 60 is threaded through loops 80 and tightened.

INDUSTRIAL APPLICABILITY

The present invention is ideally suited for baseball or softball batting practice. While the invention has been disclosed in its preferred form, it is to be understood that the specific embodiment thereof as disclosed and illustrated herein is not to be considered in a limited sense and changes or modifications may be made thereto without departing from the spirit of the invention.

I claim:

1. A batting practice device for use on a playing surface by a person acting as a pitcher and another person acting as a batter comprising:

a shaft having a first end and a second end, wherein the first end is configured to rest on the playing surface, and wherein the shaft is dimensioned such that the second end extends above the pitcher's head when the first end rests on the playing surface;

a line with a first end and a second end, a detachable swivel connector with a swivel end and a clip end wherein the first end of the line is connected to the swivel end and where the clip end is removably attached to the second end of the shaft so that the line may revolve about the second end of the shaft without wrapping around the shaft; and a ball attached to the second end of the line.

2. The batting practice device of claim 1 where the shaft is constructed of polyvinyl chloride.

3. The batting practice device of claim 1, further comprising:

a cap operatively connected to the second end of the shaft; and a pin received in the cap and extending in a direction away from the shaft.

4. The batting practice device of claim 3 further comprising a connector having a first hole and a second hole, wherein the pin is received in the first hole such that the connector is movably retained by the pin to allow rotation of the connector about an elongate axis of the pin, and wherein the first end of the line is operatively connected to the second hole of the connector.

5. The batting practice device of claim 1 further comprising an anchoring device attached to the first end of the shaft which the pitcher may stand on to substantially prevent movement of the first end of the shaft with respect to the playing surface during use.

6. The batting practice device of claim 1 wherein the shaft is at least six feet long.

7. The batting practice device of claim 1 further comprising a ball attachment having at least one strap which wraps at least partially around the circumference of the ball, and wherein the at least one strap has two ends which are secured to the second end of the line and cinched such that the ball cannot escape from the strap when swung about the shaft or struck by the batter.

8. A batting practice device for use on a playing surface by a person acting as a pitcher and another person acting as a batter, comprising:

a shaft having a first end and a second end;

a line with a first end and a second end, wherein the first end of the line is attached to the second end of the shaft so that the line may revolve about the second end of the shaft without wrapping around the shaft;

a ball; and a ball attachment having at least two straps that wrap substantially around the ball, wherein each of the at least two straps has two ends, wherein each end is folded back and permanently attached to its strap to form a closed loop, and wherein the second end of the line is threaded through each loop and cinched to prevent the ball from escaping when swung about the shaft or struck by the batter.

9. The batting practice device of claim 8 wherein the ball attachment has a first strap and a second strap, and wherein the first strap is attached in a substantially perpendicular fashion to the second strap.

10. The batting practice device of claim 8 wherein the shaft is dimensioned such that the second end of the shaft extends above the pitcher's head when the first end rests on the playing surface.

11. The batting practice device of claim 8, wherein each strap has a substantially flat surface and width, wherein the substantially flat surface of each strap contacts the ball, and wherein the width of the strap tends to prevent the strap from slipping on the cinched line.

12. A method for batting practice by a person acting as a pitcher and a person acting as a batter without having to retrieve balls comprising:

providing a batting practice device comprising a shaft with a lower end and an upper end, a line with a first end and a second end, and a ball, wherein the first end of the line is attached to the upper end of the shaft with a detachable swivel connector having a swivel end and a clip end wherein the first end of the line is connected to the swivel end and the second end of the shaft is connected to the clip end, and the second end of the line is attached to the ball, and wherein the length of the shaft is greater than the height of the pitcher;

positioning the pitcher at a distance away from the batter;

holding the shaft by the pitcher and resting the lower end on a playing surface such that substantially all the weight of the batting practice device is supported by the playing surface;

pitching the ball by the pitcher by moving the upper end of the shaft and pivoting the lower end of the shaft such that the line revolves about the upper end and above the pitcher's head, and such that the ball orbits about the shaft at a selected vertical height above the playing surface which allows the batter to strike the ball;

positioning the batter at a distance away from the pitcher such that the batter is outside the orbit of the ball but is sufficiently near the orbit of the ball such that the batter may strike the ball with a bat as the ball approaches the batter; and swinging the bat by the batter to hit the ball as the ball approaches the batter.

13. The method for batting practice of claim 12 wherein the pitching step is performed by moving the upper end of the shaft such that the ball orbits about the shaft in a clockwise direction as viewed from a point substantially directly above the pitcher, to allow the batter to bat left-handed.

14. The method for batting practice of claim 12 wherein the pitching step is performed by moving the upper end of the shaft such that the ball orbits about the shaft in a counter-clockwise direction as viewed from a point substantially directly above the pitcher, to allow the batter to bat right-handed.

15. The method for batting practice of claim 12 further comprising providing an anchor device to the lower end of the shaft and stepping on the anchor device by the pitcher to prevent lateral movement of the lower end of the shaft during use.

16. A batting practice device for use on a playing surface by a person acting as a pitcher and another person acting as a batter, comprising:

a shaft having a first end and a second end, wherein the first end is configured to temporarily rest on the playing surface, and wherein the shaft is dimensioned such that the second end extends above the pitcher's head when the first end rests on the playing surface;

a cord stabilizer attached to the shaft adjacent the shaft's first end, wherein the cord stabilizer is configured so that the person acting as a pitcher may step on the cord stabilizer to prevent the first end of the shaft from sliding;

a line with a first end and a second end, wherein the first end of the line is operatively connected to the second end of the shaft so that the line may revolve about the second end of the shaft without wrapping around the shaft; and a ball attached to the second end of the line.

* * * * *